US006598333B1

(12) United States Patent
Randazzo et al.

(10) Patent No.: US 6,598,333 B1
(45) Date of Patent: Jul. 29, 2003

(54) SCOPE MOUNTING SYSTEM

(75) Inventors: Robert S. Randazzo, Hayesville, NC (US); David R. Brewer, Rosemary Beach, FL (US)

(73) Assignee: Zeroed Systems, Inc., Hayesville, NC (US)

( * ) Notice: Subject to any disclaimer, the term of this patent is extended or adjusted under 35 U.S.C. 154(b) by 0 days.

(21) Appl. No.: 10/167,670

(22) Filed: Jun. 11, 2002

(51) Int. Cl.[7] ..... F41G 1/38
(52) U.S. Cl. ..... 42/127; 42/124; 42/125
(58) Field of Search ..... 42/125, 124, 126, 42/127

(56) References Cited

U.S. PATENT DOCUMENTS 2,583,260 A * 1/1952 Felix ..... 42/126
3,559,940 A * 2/1971 Kruzell ..... 42/127
3,750,318 A * 8/1973 Burris ..... 42/127
4,317,304 A * 3/1982 Bass ..... 42/125
5,068,968 A * 12/1991 Sillery ..... 89/200
5,669,173 A * 9/1997 Rodney, Jr. ..... 42/124
5,680,725 A * 10/1997 Bell ..... 42/127

* cited by examiner

*Primary Examiner*—Charles T. Jordan
*Assistant Examiner*—John W. Zerr
(74) *Attorney, Agent, or Firm*—Peter J. Van Bergen

(57) ABSTRACT

A scope mounting system includes a one or two-piece base and a plurality of scope support assemblies. Mating portions of the base and scope support assemblies have parallel v-notches engaged with parallel flat lands to set the position of each support assembly relative to the sighting direction of a weapon to which the base is attached. The "flat land to v-notch" interengagement guarantees that the flat portions of all v-notches will engage one another to prevent movement along the weapon's sighting direction. Each scope support assembly clamps to the base in a way that prevents movement thereof in a two-dimensional plan perpendicular to the weapon's sighting direction.

20 Claims, 3 Drawing Sheets

SCOPE MOUNTING SYSTEM

FIELD OF THE INVENTION

The invention relates generally to the mounting of a scope to a weapon, and more particularly to a scope mounting system that holds a scope securely to a weapon, allows for quick movement to a different eye relief position, and provides for a return to zero if the scope is removed and then put back on the weapon.

BACKGROUND OF THE INVENTION

Rifles are typically designed to permit the attachment of a telescope (or scope as it will be referred to hereinafter) to the top of the rifle using one of a variety of commercially-available ring-type mounting systems. In general, these ring-type mounting systems have two ring assemblies that capture the scope at two positions. Each ring assembly is then attached to a base (mounted on the rifle) by means of a clamping system. While the specifics of the clamping system may differ, the general approach is to utilize jaws that are drawn together by means of a screw that is keyed to the base so that the ring cannot move. The keyway slots or boreholes that receive the screw must be sized with sufficient tolerances to receive the screw. However, these tolerances can lead to a scope mounting system that can shift when the rifle is fired or during the general handling of the rifle. This means that the scope (supported by the mounting system) may have to be "zeroed" (i.e., the well-known process of aligning a scope's reticle with the aimpoint of the rifle to which it is attached) over and over again. Further, each time the scope is repositioned on the rifle to achieve a desired "eye relief" for a shooter, the scope must be re-zeroed.

SUMMARY OF THE INVENTION

Accordingly, it is an object of the present invention to provide a scope mounting system for rifle.

Another object of the present invention is to provide a scope mounting system that fixes the system to a rifle in all directions.

Still another object of the present invention is to provide a scope mounting system that retains its zeroed position during use.

A still further object of the present invention is to provide a scope mounting system that can be moved to accommodate a new eye relief position without requiring re-zeroing of the scope.

Other objects and advantages of the present invention will become more obvious hereinafter in the specification and drawings.

In accordance with the present invention, a scope mounting system has a one or two-piece base that attaches or is integral with a weapon. The base has an exposed portion at least partially defined by a first plurality of parallel v-notches and a first plurality of parallel flat lands arranged in an alternating fashion and extending perpendicular to the sighting direction of the weapon when the base is attached to the weapon. Each of a plurality of scope support assemblies has a clamping means for rigidly engaging the base and support means for supporting a portion of a scope. The clamping means includes a notched portion defined by a second plurality of parallel v-notches and a second plurality of parallel flat lands arranged in an alternating fashion. Each of the first plurality of parallel v-notches and each of the second plurality of parallel v-notches are identically sized and shaped in terms of their cross-section. Similarly, each of the first plurality of parallel flat lands and each of the second plurality of parallel flat lands are identically sized and shaped in terms of their cross-section. The clamping means further includes a jaw portion defined by first and second jaws movable towards and away from each other in a direction coincident with the second plurality of parallel v-notches. The clamping means is fixed in a first direction coincident with the sighting direction when the notched portion engages the exposed portion of the base such that the second plurality of parallel flat lands interlock with a portion of the first plurality of parallel v-notches while the second plurality of parallel v-notches interlock with a portion of the first plurality of parallel flat lands. Further, the clamping means is fixed in a second direction perpendicular to the sighting direction when the first and second jaws are moved towards one another to rigidly engage the base with the notched portion of the clamping means engaging the exposed portion of the base.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
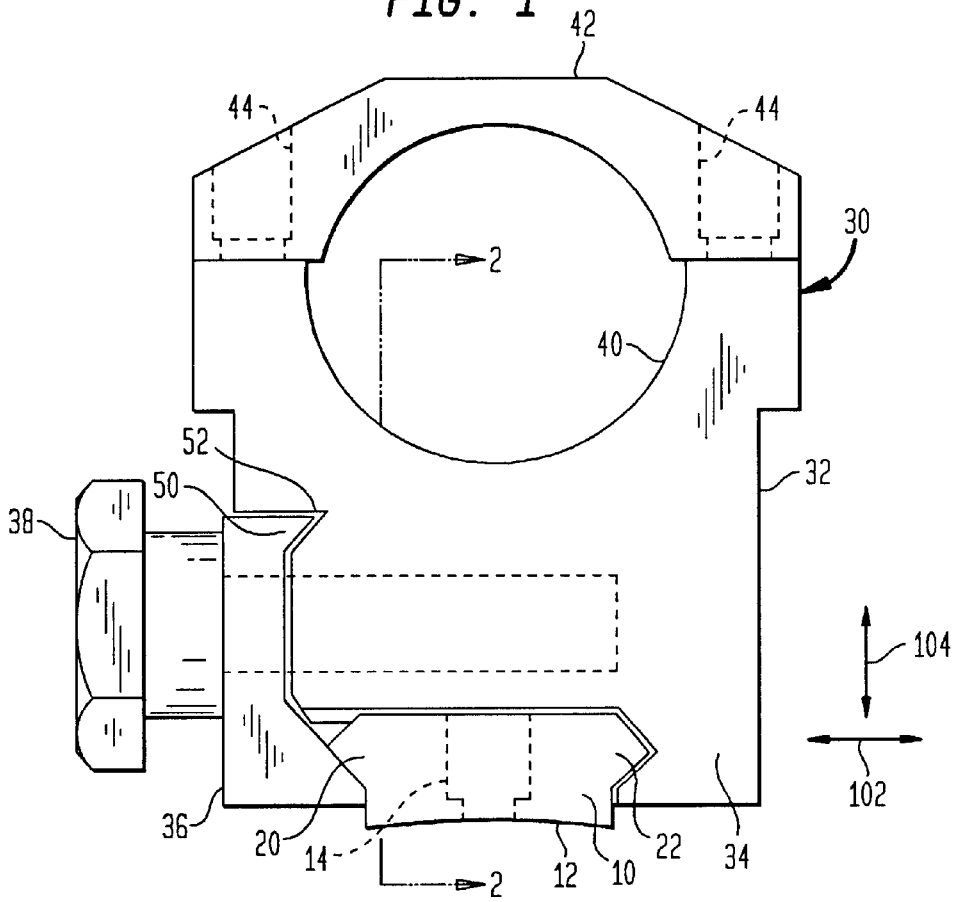
FIG. 1 is an end view of one scope support assembly coupled to a base in accordance with an embodiment of the present invention.
Figure 2:
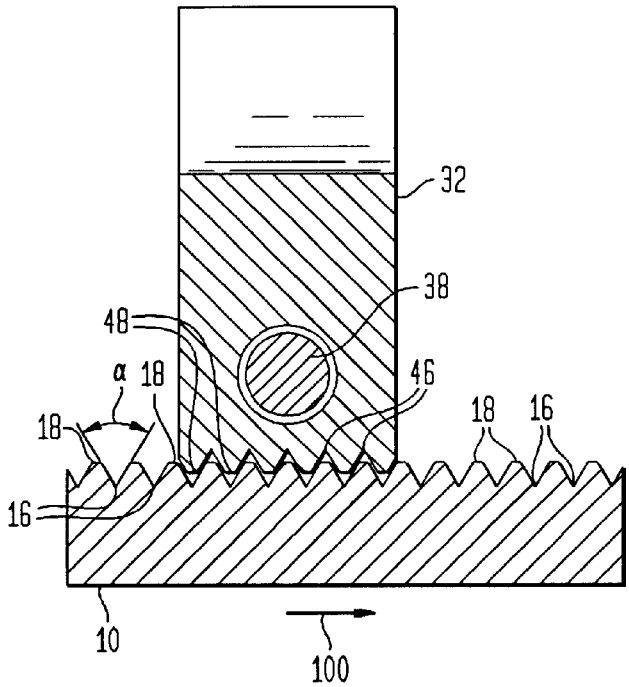
FIG. 2 is a side cross-sectional view taken along line 2—2 in FIG. 1.

Referring now to the drawings, and more particularly to FIGS. 1 and 2, a portion of the scope mounting system according to the present invention is shown in end and side cross-sectional views, respectively. A base 10 is shaped at its underside 12 to mate with the top portion of a weapon such as a rifle (not shown) that can make use of a scope for sighting purposes. It is to be understood that the particular shape of underside 12 can be other than shown without departing from the scope of the present invention. Base 10 can be attached to a weapon using screws (not shown) that pass through one or more boreholes 14 provided in base 10. Boreholes 14 can be countersunk in base 10 so that the mounting screws do not obstruct the operative portion of base 10. Note that boreholes 14 could be eliminated if base 10 were configured as an integral portion of a weapon.

Figure 3:
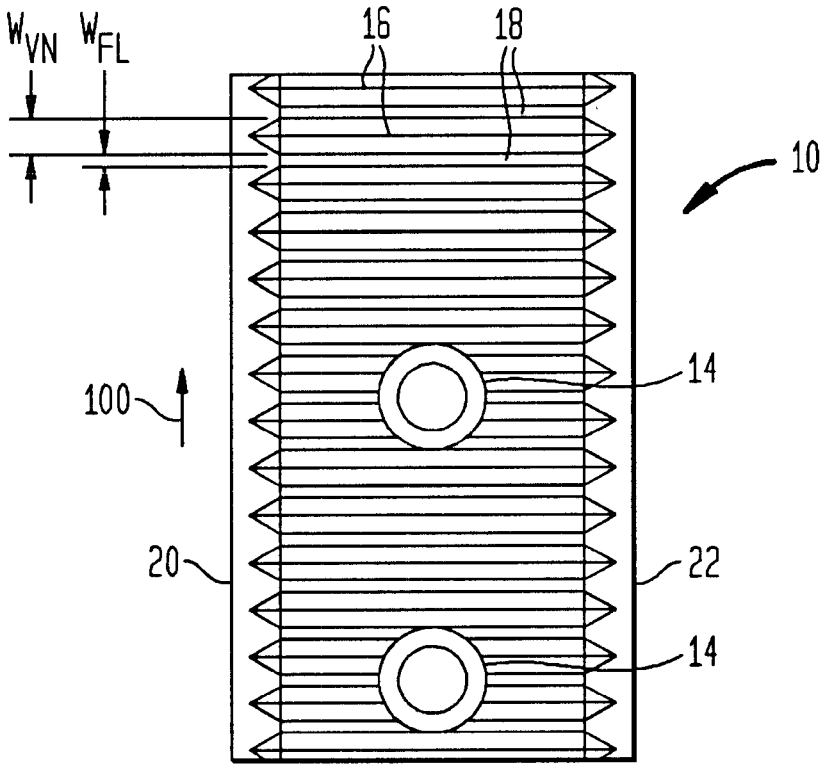
FIG. 3 is a top plan view of the base in FIG. 1.

Referring additionally to FIG. 3, the top of base 10 has a plurality of identically sized/shaped v-notches 16 formed therein and extending thereacross. Defined on either side of each v-notch 16 is a flat land 18 such that a plurality of identically sized/shaped flat lands 18 are also defined by the top of base 10. The width $W_{FL}$ of each flat land 18 must be small enough to fit within the width $W_{VN}$ of a v-notch 16. For reasons that will be explained further below, base 10 is configured such that parallel v-notches 16 and flat lands 18 extend perpendicular to the sighting direction of a weapon (not shown) to which base 10 is attached. The sighting direction is indicated in the figures by the arrow referenced by numeral 100. In the illustrated embodiment, each of v-notches 16 has a notch angle $\alpha$ of approximately 60°. However, it is to be understood notch angle $\alpha$ could be in the range of approximately 50–70° without departing from the scope of the present invention.

The sides of base 10 are shaped as rails 20 and 22 to define clamping surfaces on either end of and perpendicular to notches 16 and flat lands 18. Rails 20 and 22 are gripped by movable jaws of a scope support assembly 30. More specifically, scope support assembly 30 has a main body 32 that includes an integral jaw 34 shaped to positively engage rail 22. A movable clamping jaw 36 is shaped to simultaneously engage main body 32 and rail 20. Jaw 36 is coupled to main body 32 in a movable fashion by means of, for example, a screw 38 that passes through jaw 36 and is threadably engaged in main body 32. In general, as screw 38 is turned into main body 32, jaw 36 is moved towards jaw 34 to capture rails 20 and 22 of base 10.

Figure 4:
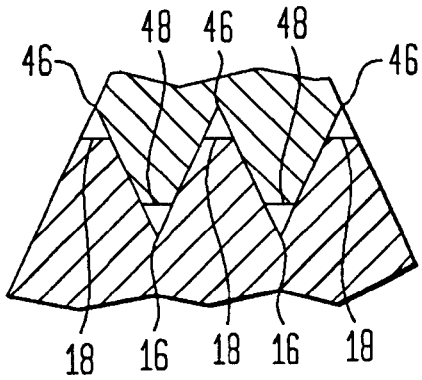
FIG. 4 is an enlarged view of a single flat land to v-notch engagement utilized by the present invention.

Scope support assembly 30 will be used to positively support a scope as will be explained further below. To properly align the scope with base 10, the underside of main body 32 between jaws 34 and 36 is configured with a plurality of parallel v-notches 46 alternating with a plurality of parallel flat lands 48. The cross-sectional shape and size of v-notches 46 (to include the notch angle thereof) is identical to that of v-notches 16 while the cross-section shape and size of flat lands 48 is identical to that of flat lands 18. Accordingly, as illustrated in FIG. 4, when flat lands 48 engage v-notches 16 and flat lands 18 engage v-notches 46, contact along the sides of the v-notches is guaranteed since the flat lands cannot "bottom out" in the apex of an engaged v-notch.

With the parallel v-notches and flat lands of base 10 and main body 32 interengaged as shown, the position of scope support assembly 30 is set along sighting direction 100. To fix assembly 30 in this position, jaws 34 and 36 are drawn together about rails 20 and 22 thereby capturing base 10 therebetween and preventing movement of assembly 30 in a direction 102 (FIG. 1) perpendicular to sighting direction 100. In addition, rails 20/22 and jaws 34/36 can be configured to draw main body 32 towards base 10 as jaws 34/36 are tightened. In this way, scope support assembly 30 is also fixed in a direction 104 (i.e., the third dimension) perpendicular to directions 100 and 102 such that the two-dimensional plane defined by directions 102 and 104 is perpendicular to sighting direction 100. For example, in the illustrated embodiment, rails 20 and 22 are configured as horizontally-extending wedge-shaped rails. Jaw 34 is shaped to positively receive rail 22. Movable jaw 36 engages the underside of rail 20 and has a horizontally-extending wedge-shaped tooth 50 that positively engages a horizontally-extending v-notch 52 formed in main body 32. In this way, main body 32 is drawn along direction 104 as jaws 34/36 are drawn together in a direction coincident with direction 102.

Main body 32 further defines a portion of a support ring that will be used to positively capture a scope. More specifically, main body 32 defines a lower or cradling portion 40 of the support ring. The upper or capture portion 42 of the support ring is attachable to cradling portion 40 by means of, for example, screws (not shown) that pass through boreholes 44 on either side of capture portion 42 and thread into cradling portion 40 on either side thereof. Note that rather than being completely separable from cradling portion 40, capture portion 42 could be hinged thereto and attachable on just one side. Further, the scope capture ring defined by portions 40 and 42 could be constructed from more than two pieces without departing from the scope of the present invention.

Figure 5:
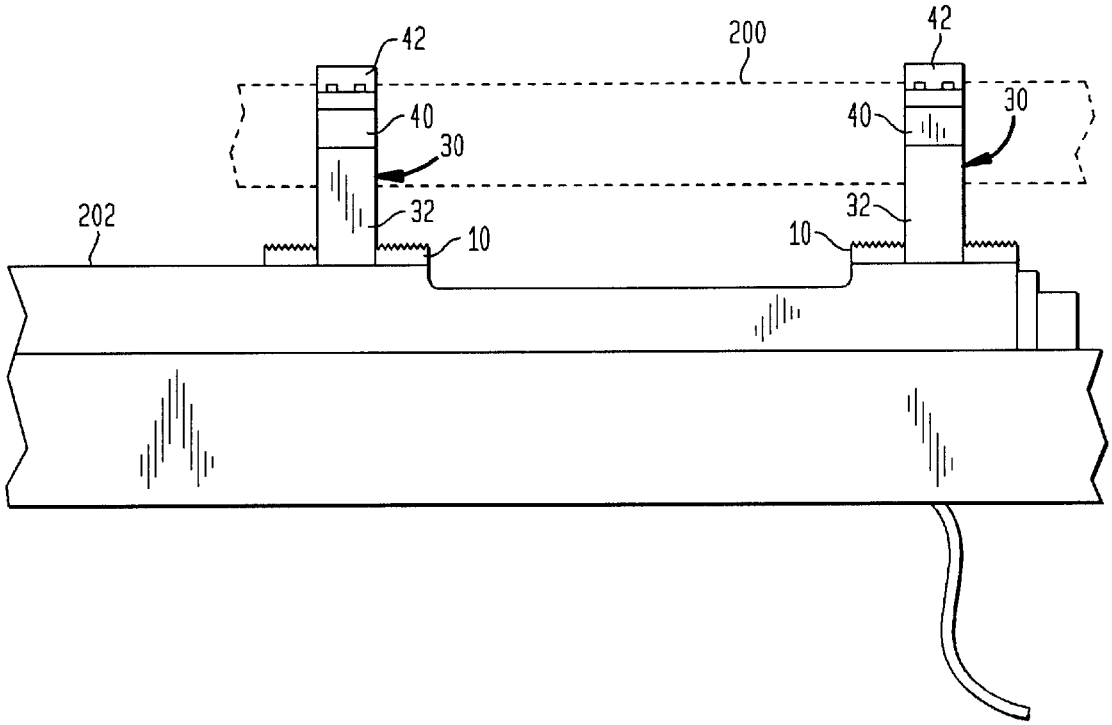
FIG. 5 is a side view of two bases of the present invention coupled to a weapon with a scope support assembly coupled to each of the bases.

Use of the present invention will now be explained with the aid of FIG. 5 where two bases 10 and two scope support assemblies 30 couple a scope 200 (shown by phantom lines) to a rifle 202. Each of bases 10 is attached to (or made integrally with) rifle 202 as explained above. Note that a single base could be used although its use would add to the overall weight of rifle 202. Main body 32 of each assembly 30 is positioned and attached to a respective base 10 as described above. With capture portion 42 of each assembly's support ring removed, scope 200 is laid into each cradling portion 40 and capture portions 42 are attached thereby capturing scope 200 in a fixed position relative to the sighting direction of rifle 202. If it is necessary to re-position scope 200 fore or aft for eye relief (e.g., to accommodate a change in a shooter's clothing), scope support assemblies 30 can be loosened and re-positioned on bases 10 without removing scope 200 from assemblies 30. Thus, the present invention eliminates the need to re-zero scope 200 to accommodate eye relief re-positioning.

The advantages of the present invention are numerous. The scope mounting system rigidly couples a scope to a weapon in each of three perpendicular directions to eliminate scope movement during handling and use of the weapon. The "flat land to v-notch" interengagement guarantees that the flat portions of all v-notches will engage one another to prevent movement along the weapon's sighting direction. At the same time, the clamping action of the scope support assemblies fixes movement in a two-dimensional plan perpendicular to the weapon's sighting direction.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A scope mounting system, comprising:

base means for attachment to a weapon, said base means having an exposed portion at least partially defined by a first plurality of parallel v-notches and a first plurality of parallel flat lands arranged in an alternating fashion and extending perpendicular to the sighting direction of the weapon when said base means is attached to the weapon;

a plurality of scope support assemblies, each of said plurality of scope support assemblies having a clamping means for rigidly engaging said base means and having support means for supporting a portion of a scope;

said clamping means including a notched portion defined by a second plurality of parallel v-notches and a second plurality of parallel flat lands arranged in an alternating fashion, each of said first plurality of parallel v-notches and each of said second plurality of parallel v-notches being identically sized and shaped in cross section, and each of said first plurality of parallel flat lands and each of said second plurality of parallel flat lands being identically sized and shaped in cross section; and said clamping means further including a jaw portion defined by first and second jaws movable towards and away from each other in a direction coincident with said second plurality of parallel v-notches, wherein said clamping means is fixed in a first direction coincident with the sighting direction when said notched portion engages said exposed portion of said base means such that said second plurality of parallel flat lands interlock with a portion of said first plurality of parallel v-notches while said second plurality of parallel v-notches interlock with a portion of said first plurality of parallel flat lands, and wherein said clamping means is fixed perpendicular to the sighting direction when said first and second jaws are moved towards one another to rigidly engage said base means with said notched portion of said clamping means engaging said exposed portion of said base means.

2. A scope mounting system as in claim 1 wherein said base means comprises a separate base for use with each of said plurality of scope support assemblies.

3. A scope mounting system as in claim 1 wherein each of said first plurality of parallel v-notches and each of said second plurality of parallel v-notches has a notch angle of approximately 60°.

4. A scope mounting system as in claim 1 wherein said first and second jaws are defined on opposing ends of said notched portion.

5. A scope mounting system as in claim 1 wherein said support means comprises a ring-shaped support through which the scope extends and is captured.

6. A scope mounting as in claim 5 wherein said ring-shaped support comprises at least two separable portions that can be uncoupled from one another to permit cradling of the scope and that can be coupled to one another to capture the scope so-cradled.

7. A scope mounting system, comprising:

base means for attachment to a weapon, said base means having an exposed portion at least partially defined by a first plurality of parallel v-notches and a first plurality of parallel flat lands arranged in an alternating fashion and extending perpendicular to the sighting direction of the weapon when said base means is attached to the weapon, said base means further defining rails along opposing sides of said base means, said rails extending parallel to the sighting direction when said base means is attached to the weapon;

a plurality of scope support assemblies, each of said plurality of scope support assemblies having a clamping means for rigidly engaging said base means and having support means for supporting a portion of a scope;

said clamping means including a notched portion defined by a second plurality of parallel v-notches and a second plurality of parallel flat lands arranged in an alternating fashion, each of said first plurality of parallel v-notches and each of said second plurality of parallel v-notches being identically sized and shaped in cross section, and each of said first plurality of parallel flat lands and each of said second plurality of parallel flat lands being identically sized and shaped in cross section;

said clamping means further including a jaw portion defined by first and second jaws movable towards and away from each other in a direction coincident with said second plurality of parallel v-notches, wherein said clamping means is fixed in a first direction coincident with the sighting direction when said notched portion engages said exposed portion of said base means such that said second plurality of parallel flat lands interlock with a portion of said first plurality of parallel v-notches while said second plurality of parallel v-notches interlock with a portion of said first plurality of parallel flat lands, and wherein said clamping means is fixed perpendicular to the sighting direction when said first and second jaws are moved towards one another to clamping means engaging said exposed portion of said base means.

8. A scope mounting system as in claim 7 wherein said base means comprises a separate base for use with each of said plurality of scope support assemblies.

9. A scope mounting system as in claim 7 wherein each of said first plurality of parallel v-notches and each of said second plurality of parallel v-notches has a notch angle of approximately 60°.

10. A scope mounting system as in claim 7 wherein said first and second jaws are defined on opposing ends of said notched portion.

11. A scope mounting system as in claim 7 wherein said support means comprises a ring-shaped support through which the scope extends and is captured.

12. A scope mounting as in claim 11 wherein said ring-shaped support comprises at least two separable portions that can be uncoupled from one another to permit cradling of the scope and that can be coupled to one another to capture the scope so-cradled.

13. A scope mounting system as in claim 7 wherein said rails and said first and second jaws are configured to draw said notched portion of said clamping means towards said exposed portion of said base means when said first and second jaws are moved towards one another and engage said rails, and wherein movement of said notched portion towards said exposed portion is arrested by interengagement of i) said second plurality of parallel flat lands and said portion of said first plurality of parallel v-notches, and ii) said second plurality of parallel v-notches and said portion of said first plurality of parallel flat lands.

14. A scope mounting system, comprising:

base means for attachment to a weapon, said base means having an exposed portion at least partially defined by a first plurality of parallel v-notches and a first plurality of parallel flat lands arranged in an alternating fashion and extending perpendicular to the sighting direction of the weapon when said base means is attached to the weapon;

first and second scope support assemblies positioned at spaced-apart positions along said base means, each of said first and second scope support assemblies having a clamping means for rigidly engaging said base means at one of said spaced-apart positions, each of said first and second scope support assemblies further having support means for securely supporting a portion of a scope independently of said clamping means;

said clamping means including a notched portion defined by a second plurality of parallel v-notches and a second plurality of parallel flat lands arranged in an alternating fashion, each of said first plurality of parallel v-notches and each of said second plurality of parallel v-notches being identically sized and shaped in cross section, and each of said first plurality of parallel flat lands and each of said second plurality of parallel flat lands being identically sized and shaped in cross section; and said clamping means further including a jaw portion defined by first and second jaws movable towards and away from each other in a direction coincident with said second plurality of parallel v-notches, wherein said clamping means is fixed in a first direction coincident with the sighting direction when said notched portion engages said exposed portion of said base means such that said second plurality of parallel flat lands interlock with a portion of said first plurality of parallel v-notches while said second plurality of parallel v-notches interlock with a portion of said first plurality of parallel flat lands, and wherein said clamping means is fixed perpendicular to the sighting direction when said first and second jaws are moved towards one another to rigidly engage said base means with said notched portion of said clamping means engaging said exposed portion of said base means.

15. A scope mounting system as in claim 14 wherein said base means comprises a separate base for use with each of said first and second scope support assemblies.

16. A scope mounting system as in claim 14 wherein each of said first plurality of parallel v-notches and each of said second plurality of parallel v-notches has a notch angle of approximately 60°.

17. A scope mounting system as in claim 14 wherein said first and second jaws are defined on opposing ends of said notched portion.

18. A scope mounting system as in claim 14 wherein said support means comprises a ring-shaped support through which the scope extends and is captured.

19. A scope mounting as in claim 18 wherein said ring-shaped support comprises at least two separable portions that can be uncoupled from one another to permit cradling of the scope and that can be coupled to one another to capture the scope so cradled.

20. A scope mounting system as in claim 14 wherein said base means and said first and second jaws are configured to draw said notched portion of said clamping means towards said exposed portion of said base means when said first and second jaws are moved towards one another and engage said base means, and wherein movement of said notched portion towards said exposed portion is arrested by interengagement of i) said second plurality of parallel flat lands and said portion of said first plurality of parallel v-notches, and ii) said second plurality of parallel v-notches and said portion of said first plurality of parallel flat lands.

* * * * *